United States Patent [19]

Hall

[11] 4,423,921

[45] Jan. 3, 1984

[54] TAB RECEPTACLE TERMINAL

[75] Inventor: Thomas E. Hall, Fort Wayne, Ind.

[73] Assignee: Essex Group, Inc., Fort Wayne, Ind.

[21] Appl. No.: 378,574

[22] Filed: May 17, 1982

[51] Int. Cl.[3] ..... H01R 15/12

[52] U.S. Cl. ..... 339/256 SP; 339/258 S

[58] Field of Search ..... 339/256 SP, 258 R, 258 S, 339/258 P

[56] References Cited

U.S. PATENT DOCUMENTS

| | | | |
|---|---|---|---|
| 2,600,190 | 6/1952 | Batcheller | 339/256 |
| 2,697,820 | 12/1954 | Elliott et al. | 339/256 SP |
| 2,759,165 | 8/1956 | Batcheller | 339/256 |
| 2,774,055 | 12/1956 | Batcheller | 339/258 |
| 2,774,951 | 12/1956 | Kinkaid et al. | 339/258 |
| 3,086,193 | 4/1963 | Berg | 339/258 |
| 3,215,975 | 11/1965 | Kinkaid | 339/256 SP |
| 3,550,069 | 12/1970 | Teagno | 339/256 SP |
| 3,644,872 | 2/1972 | Russo | 339/256 SP X |
| 3,729,701 | 4/1973 | Smith | 339/258 S |
| 4,174,878 | 11/1979 | Debaigt | 339/256 SP X |

*Primary Examiner*—William R. Briggs
*Attorney, Agent, or Firm*—Robert D. Sommer

[57] ABSTRACT

An electrical tab receptacle terminal for mating with a complementary flat rectangular tab comprises a generally channel-shaped receptacle portion having a floor, two side walls upstanding from the floor, inturned flanges along the upper edges of the side walls, and an upwardly bowed deflectable tongue of generally trapezoidal shape integral with the floor at a juncture therewith which extends across the full width of the floor. The tongue has a centrally disposed detent on its upper surface and a free end offset slightly below the floor at the forward tab-entry end of the receptacle portion. Each of the inturned flanges has a downwardly embossed free end region extending through a major length thereof to form a lower narrow planar contact surface. The forward part of the receptacle portion is arranged and shaped to facilitate ready insertion of a tab between the tongue and the contact surfaces of the flanges.

1 Claim, 5 Drawing Figures

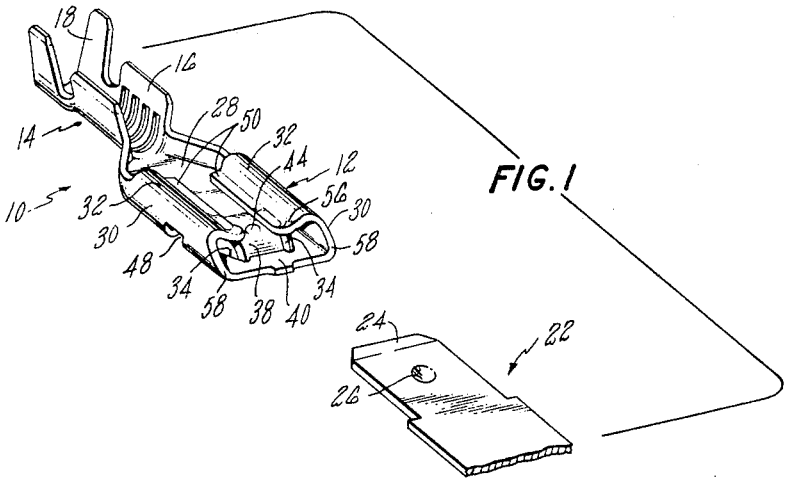
FIG. 1
FIG. 3
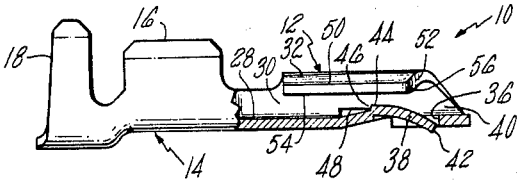
FIG. 2
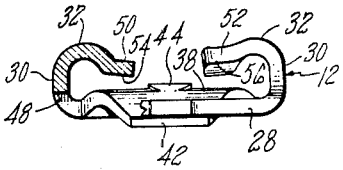
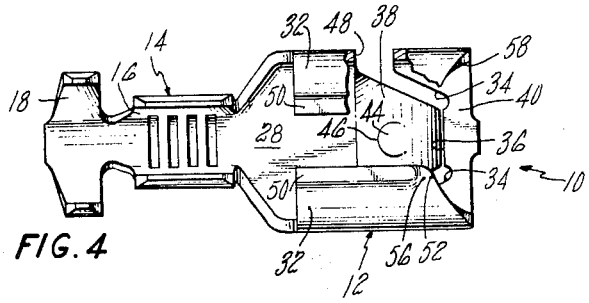
FIG. 4
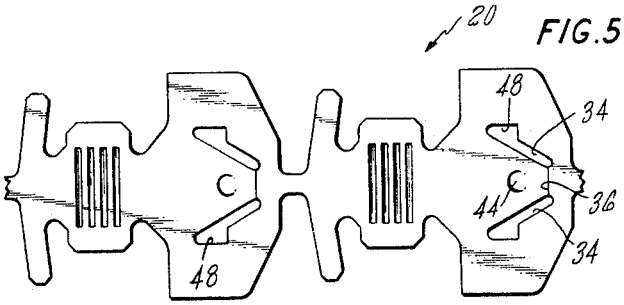
FIG. 5

TAB RECEPTACLE TERMINAL

BACKGROUND OF THE INVENTION

This invention relates to an electrical tab receptacle terminal having a generally channel-shaped receptacle portion for receiving a substantially flat rectangular tab having a recess or aperture therein.

Tab receptacle terminals of this general type are well known in many different forms including, for example, those described in the Batcheller U.S. Pat. Nos. 2,600,190, 2,774,055, and 2,759,165, the Kinkaid et al U.S. Pat. No. 2,774,951 and the Berg U.S. Pat. No. 3,086,193. One of the problems associated with such receptacle terminals is the high insertion force required to initially insert tabs in the terminals. There is also a tendency for the spring action of the tab-engaging portions of such terminals to be weakened after one or more cycles of tab insertion and removal, resulting in impaired mechanical and electrical characteristics. Such terminals are also susceptible to accidental separation from the tabs under adverse operating conditions such as vibration encountered in automotive vehicle and home appliance applications.

SUMMARY OF THE INVENTION

The present invention provides an improved tab receptacle terminal which has an entrance in which a tab is easily inserted without an excessive force, which maintains adequate contact pressure with the tab after repeated insertions and extractions, and which maintains good electrical and mechanical characteristics in use even under adverse operating conditions such as vibration. The tab receptacle terminal according to the present invention is economically formed from sheet metal and comprises a generally channel-shaped receptacle portion consisting of a floor, side walls upstanding from the side edges of the floor, and inturned flanges along the upper edges of the side walls. A deflectable tongue of generally trapezoidal shape and integral with the floor is defined by a transverse slit through the floor at the forward tab-entry end of the receptacle portion and two diverging slots in the floor extending from respective opposite ends of the slit and terminating at respective junctions of the side walls with the floor rearwardly of the slit. The tongue is bowed upwardly lengthwise to extend from its juncture with the floor and then downwardly with the free end of the tongue offset below the adjacent portion of the floor at the tab-entry end. The tongue has a centrally disposed detent intermediate its ends for latching engagement with a recess or aperture in a tab when inserted in the receptacle portion.

Each side wall is provided with an aperture communicating with a respective one of the diverging slots. The forward edge of each side wall is inclined upwardly and rearwardly from the tab-entry end of the floor, and the leading edges of the flanges extend inwardly and rearwardly in spaced converging relation from their respective junctures with the forward edges of the side walls. Each flange has a downwardly embossed free end region extending through a major length thereof and terminating short of the respective leading edge thereof to form a lower narrow planar contact surface. Each flange further has a curved region near the leading edge thereof to facilitate insertion of a tab into the forward tab-entry end of the receptacle portion.

For a better understanding of the invention, reference may be had to the following detailed description taken in connection with the accompanying drawing, in which:

BRIEF DESCRIPTION OF THE DRAWING

FIG. 1 is a perspective view of an electrical tab receptacle terminal according to the present invention and a complemental tab shown fragmentarily;

FIG. 2 is a fragmentary end view of the tab receptacle terminal of FIG. 1;

FIG. 3 is a fragmentary side elevational view of the tab receptacle terminal of FIG. 1;

FIG. 4 is a top plan view, partly broken away, of the tab receptacle terminal of FIG. 1; and FIG. 5 is a plan view of a sheet metal blank from which the tab receptacle terminal of FIG. 1 is formed.

DESCRIPTION OF THE PREFERRED EMBODIMENT

Referring now to the drawing, a tab receptacle terminal 10 according to the present invention includes a generally channel-shaped receptacle portion 12 and a wire connecting portion 14 extending from the rear end of the receptacle portion 12. As is well known, the wire connection portion 14 comprises two open U-shaped ferrules 16 and 18 for crimping respectively to the conductive core and outer insulation of a wire (not shown). The terminal 10 may be formed from a suitable electrically conductive sheet metal such as cartridge brass by shaping a blank 20 of the form shown in FIG. 5. It will be apparent that the sheet metal would be sufficiently hard and resilient to impart a spring quality to the receptacle portion 12 yet be sufficiently malleable to permit crimping of the wire connecting portion 12 about the end of a wire.

The receptacle portion 12 is adapted to receive a substantially flat rectangular sheet metal tab 22 of conventional construction. The tab 22 may be provided with a beveled leading edge 24 at its forward end and a central aperture or recess 26 rearwardly of the leading edge 24. Although the aperture 26 is shown in the form of a rounded indentation in the tab 22, it may also be a circular hole through the tab 22. A wire connecting portion (not shown) such as the wire connecting portion 14 of the terminal 10 may extend from the rear end of the tab 22.

The receptacle portion 12 includes a generally flat floor or base 28 from opposed side edges of which extend a pair of upstanding side walls 30 having inturned flanges 32 along their upper edges that overhang the side margins of the floor 28. The side walls 30 are spaced apart a distance slightly greater than the width of the tab 22.

Two diverging slots 34 and a transverse slit 36 are cut in the floor 28 to form a contact tongue 38 of generally trapezoidal shape. The transverse slit 36 extends across a central major region of the floor 28 adjacent the forward tab-entry end 40 of the receptacle portion 12. The slots 34 extend from respective opposite ends of the slit 36 and terminate at respective junctions of the side walls 30 with the floor 28 rearwardly of the tab entry end 40 near the longitudinal midpoints of the side walls 30. The tongue 38 is bowed upwardly lengthwise out of the plane of the floor 28 to extend from its juncture with the floor 28 and then downwardly toward the floor 28 with its free end 42 being offset slightly below the adjacent portion of the floor 28 at the forward tab-entry end 40 of the receptacle 12. The upwardly bowed tongue 38 projects into the path of a tab 22 when inserted into the receptacle portion 12 and is deflectable to engage the under face of the tab 22 resiliently and to press the side margins of the upper face of the tab 22 against the flanges 32. Because the juncture of the tongue 38 with the floor 28 extends along the full width of the floor 28, the spring and electrical conducting properties of the tongue 38 are excellent.

The upper surface of the tongue 38 has a centrally disposed detent 44 intermediate its ends for cooperating latching engagement with the aperture or recess 26 of the tab 22 when inserted into the receptacle portion 12. The detent 44 is preferably a generally semicircular dimple indented upwardly approximately one-third the thickness of the tongue 38 to provide an upraised abrupt rear edge 46.

Each side wall 30 is provided with a longitudinally extending aperture 48 communicating with a respective one of the slots 34 at the junction of the side wall 30 with the floor 28. These apertures 48 provide sufficient space and clearance for permitting unhindered resilient deflection of the tongue 38 at its juncture with the floor 28.

Each of the flanges 32 has a downwardly embossed free end region 50 which extends from the rearmost part of the flange 32 through a major length thereof and terminates short of the respective leading edge 52 of the flange 32. The lower surfaces 54 of the embossed regions 50 are substantially coplanar and are substantially parallel to the floor 28 to provide narrow contact surfaces adapted to bear against the upper face of a tab 22 inserted into the receptacle portion 12. These contact surfaces 54 are spaced above the floor 28 by a distance substantially equal to or only slightly less than the thickness of the tab 22. To facilitate entry of the tab 22 into the receptacle portion between the forward parts of the tongue 38 and the flanges 32, the free end region 56 of each flange 32 between the embossed region 50 and the leading edge 52 is upwardly curved. In addition, the leading edges 52 of the flanges 32 extend inwardly and rearwardly in spaced converging relation from their respective junctures with the forward edges 58 of the side walls 30 which are, in turn, inclined upwardly and rearwardly from their respective junctures with the floor 28 at the tab-entry end 40 of the receptacle portion 12.

The leading edges 52 of the flanges 32 and the forward edges 58 of the side walls 30 together with the forward end of the floor 28 define an enlarged open entrance at teh tab-entry end 40 of the receptacle portion 12 into which the beveled leading edge 24 of the tab 22 may be easily inserted. As the tab 22 is pushed into the entrance of the receptacle portion 12, its leading edge 22 is guided between the curved end regions 56 of the flanges 32 and the forward end portion of the floor 28. Upon further insertion of the tab 22, the upper face of the tab 22 engages the contact surfaces 54 of the flanges 32 and the lower face of the tab 22 engages the forward portion of the tongue 38. The tongue 38 is flexed downwardly upon continued insertion of the tab 22 and resiliently bears against the lower face of the tab 22 so as to press the side margins of the tab firmly against the contact surfaces 50 of the flanges 32. After the tab 22 has been fully inserted, the detent 44 on the tongue 38 enters the aperture or recess 26 on the lower face of the tab 22 to resist retraction of the tab 22 from the receptacle portion 12.

From the foregoing, it will be evident that the tab receptacle terminal 10 is of a simple and economical construction and that a tab 22 can be simply and easily inserted into its receptacle portion 12. The forces required to insert and extract a tab 22 having an aperture or recess 26 in the form of a rounded indentation will remain substantially constant during as many as fifteen cycles of insertions and extractions. The receptacle portion 12 is highly efficient in effecting a good electrical connection with an inserted tab 22 and is exceptionally durable in use under adverse operating conditions. When the receptacle portion 12 is mated with a tab 22 having an aperture 26 in the form of a circular hole, a very high force is required to extract the tab 22, thus providing an electrical connection highly resistant to inadvertent disconnection due to vibration or mishandling.

While there has been described above the principles of this invention in connection with a specific tab terminal construction, it is to be understood that this description is made only by way of example and not as a limitation to the scope of the invention.

What is claimed is:

1. An electrical tab receptacle terminal formed from sheet metal and comprising a generally channel-shaped receptacle portion for receiving a substantially flat rectangular tab having a recess or an aperture herein; said receptacle portion consisting of a floor, side walls upstanding from the side edges of said floor, and inturned flanges along the upper edges of said side walls overhanging the side margins of said floor; said floor having a transverse slit therethrough extending across a central major portion of said floor at the forward tab-entry end of said receptacle portion; said floor having two diverging slots therethrough extending from respective opposite ends of said slit and terminating at respective junctions of said side walls with said floor rearward of the forward tab-entry end of said tab receptacle portion; said floor having a deflectable tongue of generally trapezoidal shape defined by said transverse slit and said diverging slots which is arranged and adapted to bias a tab when inserted into said receptacle portion against said flanges; said tongue being bowed upwardly lengthwise to extend from its juncture with said floor and then downwardly toward the floor with the free end of said tongue being offset below the adjacent portion of said floor at the forward tab-entry end of said receptacle portion; said tongue having a centrally disposed detent intermediate its ends for cooperating latching engagement with a recess or an aperture in a tab when inserted into said receptacle portion; each of said side walls being provided with an aperture communicating with a respective one of said diverging slots to permit unhindered resilient deflection of said tongue as its juncture with said floor; each of said side walls having a forward edge inclined upwardly and rearwardly from its respective juncture with said floor at the forward tab-entry end of said receptacle portion; the leading edges of said flanges extending inwardly and rearwardly in spaced converging relation from their respective junctures with said forward edges of said side walls; each of said flanges having a downwardly embossed free end region extending through a major length thereof and terminating short of the respective leading edge thereof to form a lower narrow planar contact surface extending substantially the length of said flange; and each of said flanges having a curved region near the leading edge thereof to facilitate insertion of a tab into the forward tab-entry end of said receptacle portion.

* * * * *